United States Patent [19]

Lenk et al.

[11] Patent Number: 4,696,633

[45] Date of Patent: Sep. 29, 1987

[54] MELT SPINNING APPARATUS

[75] Inventors: Erich Lenk; Max Feth, both of Remscheid, Fed. Rep. of Germany

[73] Assignee: Barmag AG, Remscheid, Fed. Rep. of Germany

[21] Appl. No.: 738,170

[22] Filed: May 24, 1985

Related U.S. Application Data

[63] Continuation-in-part of Ser. No. 593,034, Mar. 23, 1984, Pat. No. 4,645,444.

[30] Foreign Application Priority Data

May 26, 1984 [DE] Fed. Rep. of Germany ..... 3419772

[51] Int. Cl.[4] ..... D01D 4/08

[52] U.S. Cl. ..... 425/192 S; 264/176.1; 425/378 S; 425/464

[58] Field of Search ..... 425/72 S, 182, 192 S, 425/378 S, 378 R, 379 R, 379 S, 382.2, 131.5, 461, 464, 197, 198, 190; 264/176 F, 211.12, 211.14, 211.2, 176.1

[56] References Cited

U.S. PATENT DOCUMENTS

| | | | |
|---|---|---|---|
| 2,786,504 | 3/1957 | Samler | 137/547 |
| 2,838,084 | 6/1958 | Samler | 137/15 |
| 3,104,419 | 9/1963 | La Forge | 425/198 |
| 3,407,437 | 10/1968 | Lenk | 425/464 |
| 3,480,995 | 12/1969 | Lenk | 425/464 |
| 3,500,499 | 3/1970 | Goossens | 425/192 R |
| 3,516,119 | 6/1970 | Keller | 425/191 |
| 3,546,328 | 12/1970 | Lodge et al. | 425/198 |
| 3,559,237 | 2/1971 | van den Biggelaar | 425/131.5 |
| 3,562,858 | 2/1971 | Lehner | 425/379 |
| 3,655,314 | 4/1972 | Lenk et al. | 425/378 S |
| 3,667,886 | 6/1972 | Gauthier et al. | 425/192 S |
| 3,762,854 | 10/1973 | Kilsdonk | 425/382.2 |
| 3,891,379 | 6/1975 | Lenk | 425/192 S |
| 4,035,127 | 7/1977 | Ogasawara et al. | 425/378 S |
| 4,038,005 | 7/1977 | Lenk | 425/190 |
| 4,050,866 | 9/1977 | Kilsdonk | 425/192 S |
| 4,285,651 | 8/1981 | Fetchu et al. | 425/192 R |
| 4,321,228 | 3/1982 | de Kok | 264/209.8 |
| 4,361,489 | 11/1982 | Kilsdonk et al. | 425/197 |
| 4,413,968 | 11/1983 | Bliss | 425/198 |
| 4,437,827 | 3/1984 | Moderlak et al. | 425/378 S |
| 4,494,921 | 1/1985 | Sowell | 425/72 S |

FOREIGN PATENT DOCUMENTS

| | | | |
|---|---|---|---|
| 2041905 | 3/1972 | Fed. Rep. of Germany | 264/176 F |
| 53-02618 | 1/1978 | Japan | 425/192 S |
| 1350496 | 4/1974 | United Kingdom . | |

OTHER PUBLICATIONS

W. H. Hills, "Anatomy of a Spin Beam", *Fiber Producer,* Dec. 1981, pp. 34, 36, 38, 40, 42, and 43.

*Primary Examiner*—Jay H. Woo
*Assistant Examiner*—J. Fortenberry
*Attorney, Agent, or Firm*—Bell, Seltzer, Park & Gibson

[57] ABSTRACT

A melt spinning apparatus is disclosed which comprises a stationary melt supply assembly which includes a spin block, and a nozzle assembly releasably connected to the spin block. The means for releasably connecting the nozzle assembly to the spin block includes a cylindrical connecting plug fixed to the spin block, and a tubular casing for the nozzle assembly, with the connecting plug and casing being threadedly interconnected. The mating threads are preferably in the form of a threaded bayonet joint comprising multiple thread segments so that the nozzle assembly may be attached to and removed from the connecting plug by a partial rotation of the nozzle assembly. Also, the nozzle assembly is sealed to the melt supply assembly by an arrangement which includes a piston mounted for limited movement within the casing of the nozzle assembly and below the connecting plug, and such that the piston is biased into sealing contact with the plug by the pressure of the melt.

8 Claims, 2 Drawing Figures

MELT SPINNING APPARATUS

Figure 1:
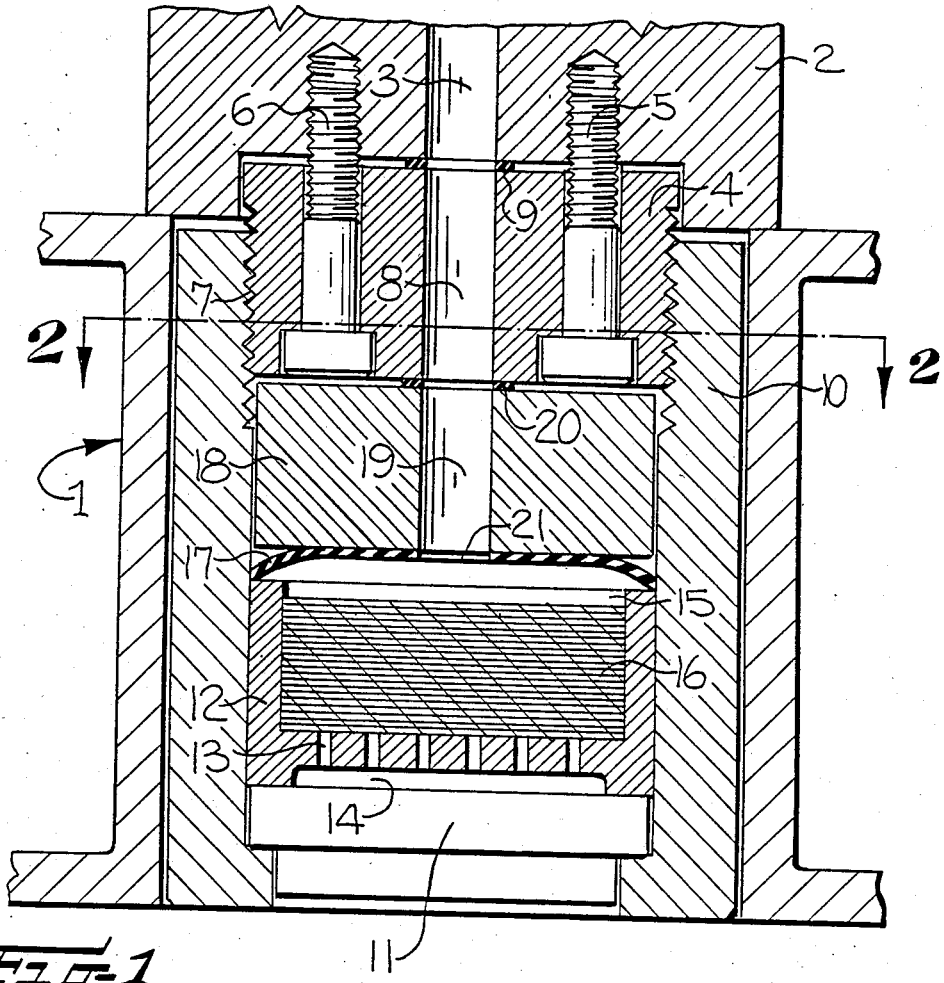

This is a continuation in part of copending application Ser. No. 593,034 filed Mar. 23, 1984 now U.S. Pat. No. 4,645,444.

The present invention relates generally to a melt spinning apparatus for extruding and spinning thermoplastic material, and more particularly to a melt spinning apparatus which includes a nozzle assembly attached thereto in such a manner as to be easily removable and replaceable.

It has been recognized that the nozzle assembly of a melt spinning apparatus should be easily removable and replaceable because a regular cleaning of the spinning nozzle is usual and necessary. Moreover, the mounting of the nozzle assembly should be designed to withstand the high melt pressures, which may be on the order of up to 200 bar or more, and additionally to absorb the forces which are necessary for a proper sealing. A variety of solutions have been proposed by the prior art. However, all of these solutions include certain disadvantages.

For example, German Auslegeschrift No. 1 096 594 describes a mounting arrangement in which the nozzle assembly is fastened to the melt supplying means by several bolts. According to Swiss Patent No. 201,920, the nozzle assembly is fixed to the melt supplying means by a type of cap screw. The disadvantage of these constructions is that the replacement of the nozzle assembly is a very complicated and time-consuming operation and the sealing effect may vary over the circumference of the sealing surface due to the fact that the screws are often not uniformly tightened. However, the substantial disadvantage of the known solutions is the time-consuming and complicated operation required to remove and exchange the nozzle assembly. This is a serious disadvantage because of the fact that a long interruption of the flow of the melt must be avoided.

The prior U.S. patent to Lenk, U.S. Pat. No. 3,891,379 discloses a melt spinning apparatus wherein each of a plurality of nozzle assemblies is inserted and withdrawn from the spinning head in a lateral direction, which can be difficult by reason of inadequate space. Also, the disclosed mounting arrangement requires the disassembly of several nozzle assemblies to reach the interior nozzle assemblies. Still further, the outer casing walls of this prior construction are subject to being flexed outwardly by the pressure of the melt in the nozzle assemblies.

It is accordingly an object of the present invention to provide a melt spinning apparatus which avoids the above noted disadvantages of the prior art constructions.

It is also an object of the present invention to provide a melt spinning apparatus wherein the individual nozzle assemblies may be individually and easily removed in a downward direction.

These and other objects and advantages are achieved in the embodiments illustrated and described herein by the provision of a melt spinning apparatus which includes a stationary melt supply assembly having a connecting plug mounted thereto, with the melt supply line extending through the assembly and plug. A nozzle assembly is also provided which includes an outer casing, with the connecting plug and casing having cooperating threads for releasably interconnecting the same. Preferably, means are mounted within the cavity defined by the casing and which is operable by the pressure of the melt in the cavity for sealing the nozzle assembly to the melt supply assembly. The melt spinning apparatus will thus be seen to provide a pressure resistant connecting means between the pump block and the nozzle assembly.

The pressure resistant connecting means between the nozzle assembly and the pump block includes a mechanical connecting arrangement which is able to withstand the melt pressures exerted against the nozzle assembly. Such connecting arrangement is preferably a threaded element which is composed of single-thread or multiple-thread segments which extend over only a portion of the circumference, to provide for example, a slide and twist bayonet type lock. In any case, the connecting means is so designed that the casing of the nozzle assembly may be removed from and fastened easily and quickly to the pump block without requiring the exertion of any substantial force to the connecting means from below and in an overhead manner.

The pressure resistant connecting means further includes self-sealing elements by which the interior of the casing may be sealed against the gap between the nozzle casing and the pump block, without any sealing forces being applied from outside. Sealing elements of this general type are described, for instance, in the German Patent Nos. 15 29 819 and 22 48 756, and U.S. Pat. No. 3,891,379.

The pressure resistant connecting means joins the melt supply line extending through the pump block and to the nozzle assembly in such a manner that the pressure forces exerted by the melt are absorbed and a leakproof joint is provided. In one preferred embodiment, the connecting means includes one portion in the form of a connecting plug, which is attached in a fixed manner to the pump block, as by welding. Also, the connecting plug may be attached to the pump block in a substantially fixed manner, for example by the use of bolts or tie rods. In any of these instances, the connection of the connecting plug to the pump block is not considered to be a releasable one. In other words, the connecting plug does not need to be removed from the pump block when operating the melt spinning apparatus or when removing and replacing the nozzle assembly. It is to be noted that the joining surface between the connecting plug and the pump block, which is subject to the pressure forces of the melt, essentially corresponds to the cross section of the melt supply line and is therfore small compared with the area of the surface which is subject to the pressure forces of the melt acting in the nozzle assembly. The connection between the connecting plug and the pump block may be designed in accordance with the above-mentioned conditions, and the specific connection employed is not critical.

The present invention may also be characterized by the fact that the pressure forces acting in the circular or tubular nozzle assembly casing are not transferred directly to the pump block, as has been the case in the prior art, but to an intermediate member, namely the connecting plug. The connecting plug is in turn joined to the pump block on a relatively small cross-sectional area and in a substantially non-releasable manner, as for example by bolts, tie rods, or by welding it to the pump block.

In a particular embodiment, the connecting plug is tightly connected to the pump block by means of an appropriate number of fastening bolts, and the melt supply line runs therethrough. This connection has the advantage that the force which has to be applied by the bolts may be reduced to a minimum because the sealing gasket is positioned between the connecting plug and pump block with the inner diameter of the sealing gasket being coaxially aligned with that of the melt supply line so that its radial strength may be kept small. During exchange of the nozzle assembly, the connecting plug remains in position and is not removed.

The connecting plug is provided on its circumference with a single or preferably multiple threads, or with a type of bayonet joint, the mating counterpart of which is cut into the inner surface of the nozzle casing. Particularly in case of a bayonet joint, the nozzle assemblies may be exchanged in a very short time by simply inserting and turning them by, for example, about 90° or 60°. The bayonet joint may be designed as a thread with portions of its circumference being provided with spaced recesses or slots extending in the axial direction and extending inwardly to the root of the thread.

Other constructions for mounting the connecting plug to the melt supply assembly may be selected. Thus for example the connecting plug may be mounted to the heating box by means of a single or multiple, self locking threaded interconnection.

It should be considered with each type of connection that the sealing cross section of the connecting plug is substantially less than its outer diameter or the inner diameter of the nozzle casing or of the nozzle assembly, so that only relatively small forces are needed for the joint between the connecting plug and the melt supply line. Also, the high forces caused by the considerable internal melt pressure and which act on a piston positioned in the upper end portion of the nozzle casing are absorbed by the connecting plug itself. Thus the high forces do not present a problem because of the relatively large circumference of the connecting plug, as long as an appropriate threaded interconnection with the casing is used.

Figure 2:
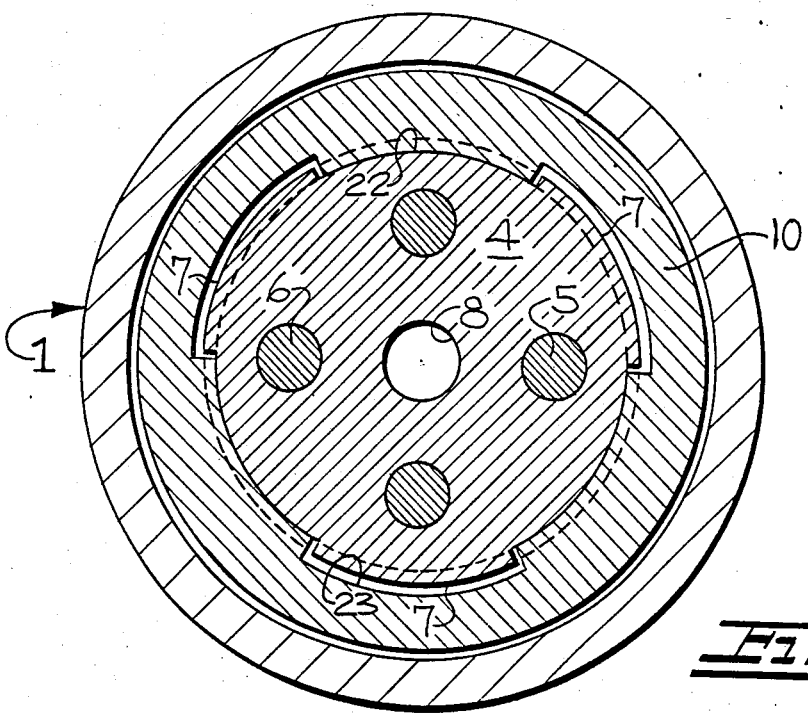

Some of the objects and advantages of the present invention having been stated, others will appear as the description proceeds when taken in connection with the accompanying drawings, in which:

FIG. 1 is a vertical cross sectional view of a melt spinning apparatus which embodies the present invention; and FIG. 2 is a horizontal sectional view taken substantially along the line 2—2 of FIG. 1, and with the plug and casing in the released position.

Referring more particularly to the drawings, a melt spinning apparatus is indicated generally at 1, and the apparatus 1 includes a pump block 2 which is surrounded by a heating box (not shown). A melt supply line 3 extends vertically through the pump block 2 and supplies the spinning apparatus. In the embodiment illustrated in the drawings, the pump block 2 is provided with a recess into which the mating upper end of a connecting plug 4 is fitted. An annular gasket 9 is positioned between the connecting plug 4 and the pump block 2 in coaxial alignment with the line 3 and forms a tight and pressure resistant sealed joint. The force of the sealing contact is essentially sealed determined by a plurality of fastening bolts 5, 6 which penetrate and hold the connecting plug 4 in position in a downwardly depending position below the pump block 2. The inner diameter of the gasket 9 corresponds to the diameter of the melt supply line 3 and also to the diameter of a melt supply duct 8 which extends vertically through the connecting plug 4, with the melt supply duct 8 being in alignment with the melt feeding line 3.

The downwardly depending portion of the connecting plug 4 is cylindrical and has a thread 7 cut into its outer circumference, which may be a bayonet joint or a multiple, self-locking thread which may be quickly tightened or released in the manner further described below.

The melt spinning apparatus 1 further includes a nozzle assembly, which includes an outer tubular casing 10 having a cylindrical bore and a shoulder at the lower end of the bore. The casing 10 encloses and supports a spinning nozzle 11, and a distribution spin plate 12 having a plurality of openings 13 extending therethrough. The spin plate 12 includes an upwardly extending cylindrical outer wall which defines a cup like receptacle 15.

The nozzle 11 is also in the form of a plate having small openings (not shown) therethrough, with the openings in the nozzle usually being smaller in size and larger in number than the openings 13 of the plate 12. It will also be seen that the casing 10 and spin plate 12 define a cavity on the upper side of the plate 12. Further, a melt chamber 14 is positioned between the nozzle 11 and the spin plate 12, and a filter pack 16 is positioned in the cup-like receptacle 15 of the spin plate 12.

In order to provide for a pressure resistant and tight connection between the nozzle assembly and the connecting plug 4, a piston 18 is positioned in the cavity above the cup-like receptacle 15 of the distribution plate 12, so that the piston 18 forms the upper end portion of the nozzle assembly. The piston 18 includes a through duct 19 which is aligned with the duct 8 of the connecting plug 4, and the piston 18 is sealed against the upper edge of the cylindrical wall of the plate 12 by an inverted plate-shaped sealing diaphragm 17. The diaphragm 17 has an opening 21 in alignment with the duct 19 of the piston 18. An annular sealing gasket 20 is provided between the upper end of the piston 18 and the lower end of the connecting plug 4, and in coaxial alignment with the supply duct 8 in the plug 4. This gasket 20 is the same type and operates in the same manner as the sealing gasket 9, described above.

In the embodiment shown in the drawings, the thread 7 is a bayonet joint having three thread segments, as best seen in FIG. 2. The thread segments are defined by three spaced recesses 22 formed in portions of its circumference and which recesses extend axially and are the same depth as the root of the thread. In the illustrated embodiment, three recesses of such type are equally distributed around the circumference. Also, the internal bore of the casing 10 includes mating thread segments and recesses 23.

In order to fasten the nozzle assembly to the connecting plug 4, the nozzle assembly is pushed upwardly onto the bayonet-type thread 7 of the connecting plug 4 and tightened only slightly by turning nozzle casing 10 by about 60°. Thereby only a slight initial stress is applied to the gasket 20. The high contact pressure which is necessary to obtain a sealing effect, is achieved by the pressure of the melt which exerts an upward force against the piston 18 and through the plate-shaped sealing diaphragm 17 so that the gasket 20 is thereby compressed. Thus, the piston 18 is sealed by the plate-shaped sealing diaphragm 17 against the interior of the nozzle casing 10, in which the piston 18 is axially movable.

As can be seen from the drawings, the force exerted by the pressure of the melt in the cross section of the interior of the nozzle casing 10 acts in the direction of the axis of the nozzle casing 10 and is absorbed by the thread 7 of the connecting plug 4 because the piston 18 is forced upwardly against the sealing gasket 20. The intensity of the force which is needed for the mounting of the connecting plug 4 is dependent on the sealing cross section of the gasket 20, which according to the invention is considerably smaller than the cross section of the connecting plug 4, so that this force is very small compared with the force acting on the connecting thread 7.

The present invention substantially facilitates the operation of exchanging the nozzle assembly. Also, this invention considerably reduces the force acting on the mounting of the nozzle assembly below the level of the force from the high pressure of the melt in the nozzle assembly. The heating box of the apparatus serves to receive a liquid and/or vaporous, pressurized heating medium and to transfer the heat to the melt containing members, particularly to the pump block 2. As far as its stability and deformability is concerned, the heating box is a critical member. By this invention, the heating box is substantially relieved from its function of absorbing the force of the melt pressure, and although the heating box can be formed of a lighter material due to this fact, its stability of shape, which is particularly important with regard to the transfer of heat to all the melt containing members and in particular to the pump block, may still be increased.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A melt spinning apparatus for extruding and spinning a thermoplastic material and comprising a stationary melt supply assembly having a cylindrical connecting plug directly mounted thereto, and with a melt supply line extending through said melt supply assembly and said connecting plug, a nozzle assembly including a spin plate having a plurality of openings extending therethrough, and a tubular casing having a cylindrical internal bore portion and enclosing and supporting said spin plate and so as to define a cavity on one side of said spin plate, thread means on said internal bore portion of said casing and said cylindrical connecting plug for releasably interconnecting said casing to said connecting plug and such that said melt supply line communicates with said cavity and thus one side of said spin plate, and such that the nozzle assembly may be readily disassembled from said melt supply assembly by rotation of said casing with respect to said connecting plug, and means mounted within said cavity between said connecting plug and said spin plate and operable by the pressure of the melt in said cavity for sealing the nozzle assembly to said melt supply assembly, said sealing means including a piston mounted in said cavity for axial movement in a direction between said connecting plug and said spin plate, said piston having an opening extending therethrough and which is in alignment with said melt supply line, and diaphragm means positioned in said cavity between said piston and said spin plate for biasing said piston against said connecting plug upon pressurized melt being received in said cavity.

2. The melt spinning apparatus as defined in claim 1 wherein said threads on the connecting plug and the threads on said casing each have axially extending recesses extending to the root of the threads and so as to permit rapid assembly and disassembly by axially moving the casing onto the plug and then rotating the casing a partial turn.

3. The melt spinning apparatus as defined in claim 1 wherein said connecting plug is separate from the remainder of said melt supply assembly, and further comprising threaded members securing said connecting plug to said assembly, with said threaded members being positioned within the boundary of said thread means on said cylindrical connecting plug.

4. The melt spinning apparatus as defined in claim 1 wherein said means for sealing the nozzle assembly to said melt supply assembly further includes an annular gasket interposed between said piston and said connecting plug and coaxially aligned with said melt supply line.

5. The melt spinning apparatus as defined in claim 4 further comprising a second annular gasket interposed between said connecting plug and said melt supply assembly and coaxially aligned with said melt supply line.

6. The melt spinning apparatus as defined in claim 5 wherein the outer diameter of said second annular gasket is substantially less than the diameter of the connecting plug.

7. A melt spinning apparatus for extruding and spinning a thermoplastic material and comprising a stationary melt supply assembly which includes a pump block, and a separate cylindrical connecting plug, with said cylindrical plug having an outer cylindrical surface, and at least one threaded member positioned within the boundary of said cylindrical outer surface and securing said connecting plug to said pump block, and a melt supply line extending through said block and said connecting plug, a nozzle assembly including a spin plate having a plurality of openings extending therethrough, and a tubular casing having a cylindrical internal bore portion and enclosing and supporting said spin plate and so as to define a cavity on one side of said spin plate, and cooperating thread means on said internal bore portion of said casing and said outer surface of said cylindrical connecting plug for releasably interconnecting said casing to said connecting plug and such that said melt supply line communicates with said cavity and thus one side of said spin plate, and such that the nozzle assembly may be readily disassembled from said melt supply assembly by rotation of said casing with respect to said connecting plug.

8. The melt spinning apparatus as defined in claim 7 wherein said cooperating threads on the connecting plug and said casing each have axially extending recesses extending to the root of the threads and so as to permit rapid assembly and disassembly by axially moving the casing onto the plug and then rotating the casing a partial turn.

* * * * *